US006786035B2

(12) United States Patent
Stickelmaier

(10) Patent No.: US 6,786,035 B2
(45) Date of Patent: Sep. 7, 2004

(54) ION THRUSTER GRID CLEAR

(75) Inventor: John F. Stickelmaier, Manhattan Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/200,658

(22) Filed: Jul. 22, 2002

(65) Prior Publication Data

US 2004/0011022 A1 Jan. 22, 2004

(51) Int. Cl.[7] ..... H05H 1/00
(52) U.S. Cl. ..... 60/202; 60/204; 313/362.1
(58) Field of Search ..... 60/202, 204; 313/362.1

(56) References Cited

U.S. PATENT DOCUMENTS 3,156,090 A * 11/1964 Kaufman ..... 60/202
3,336,748 A * 8/1967 Nakanishi ..... 60/202
3,371,489 A * 3/1968 Eckhardt ..... 60/202
5,448,883 A * 9/1995 Meserole et al. ..... 60/202
5,548,953 A * 8/1996 Hedges et al. ..... 60/202
5,646,476 A * 7/1997 Aston ..... 313/359.1
6,121,569 A * 9/2000 Miley et al. ..... 219/121.48
6,507,142 B1 * 1/2003 Tilley et al. ..... 313/239

* cited by examiner

*Primary Examiner*—Ehud Gartenberg
(74) *Attorney, Agent, or Firm*—Gates & Cooper LLP

(57) ABSTRACT

The invention discloses a method and device for clearing an ion thruster grid of contaminants. A typical method includes applying a power supply to a grid to clear contaminants, monitoring an energy applied to the grid of the applied power supply and suspending application of the power supply to the grid after the monitored energy substantially reaches a predetermined value. A typical device includes a controller for applying a power supply to a grid to clear the grid of contaminants and a timer for monitoring an energy applied to the grid of the applied power supply and suspending application of the power supply to the grid after the monitored energy substantially reaches a predetermined value.

24 Claims, 7 Drawing Sheets

ION THRUSTER GRID CLEAR

BACKGROUND OF THE INVENTION

1. Field of the Invention

The present invention relates to field driven ion propulsion systems, and particularly to methods for maintaining operation of such propulsion systems.

2. Description of the Related Art

Although the principle of ion propulsion was established many decades ago, it has only relatively recently been reduced to practical applications. Ion propulsion generally involves employing an ionized gas accelerated electrically across charged grids to develop thrust. The electrically accelerated particles can achieve speeds of approximately 30 km/second. The gas used is typically a noble gas, such as xenon. The principal advantage afforded by ion propulsion systems over conventional chemical propulsion systems is their very high efficiency. For example, with the same amount of fuel mass an ion propulsion system can achieve a final velocity as much as ten times higher than that obtainable with a chemical propulsion system.

Unfortunately, the range of ion propulsion applications is narrowed by the fact that, although they are efficient, ion propulsion systems develop very low thrust when compared with chemical propulsion systems. However, ion propulsion is well suited for space applications where low thrust is often acceptable and fuel efficiency is critical. More and more ion propulsion is becoming a component of new spacecraft designs. Spacecraft, including satellites as well as exploration vehicles, are presently making use of ion propulsion systems.

For example, ion thrusters are currently used for spacecraft control on some communications satellites. Some existing systems operate by ionizing xenon gas and accelerating it across two or three charged molybdenum grids. As the ions pass through these grids, small amounts of molybdenum are sputtered off to deposit on the downstream grids. Over time, these deposits can grow large enough to flake off and cause a short between the grids, shutting down the thruster. When this occurs, the thruster must be turned off so that the grids can be cleared, removing the short. Specialized grid clear circuitry is employed to apply a large voltage through the short, causing it to blow open.

FIG. 1 is a schematic diagram of a contaminated ion propulsion grid within an ion thruster. When the thruster is operating, ionized gas 102 is accelerated across two or more charged grids 104. However, deposits can accumulate on the grids 104 creating to a point where a short 106 is created, shutting down the thruster.

Prior art grid clear circuits employ a dropping resistor 110 coupled to a fixed voltage source 108 (e.g., the spacecraft bus voltage) to clear the grids 104. The voltage source 108 is applied (through the dropping resistor 110) to the shorted grids 104 for a predetermined length of time. However, this approach delivers varying amounts of energy depending on the resistance of the particular grid short 106. Also, using this approach, the grid clear circuit must be designed to accommodate the worst case grid short 106, without damage to the thruster. With this method, only shorts with a resistance in a limited range can be effectively cleared. Consequently, the amount of energy that can be delivered to very low or very high resistance shorts is limited, making these shorts particularly difficult to clear. On orbit experience has shown that the low resistance shorts are the most predominant type.

Ion propulsion on the NASA Deep Space One spacecraft implements a grid clear by switching a discharge power supply output across the grids to be cleared. Timing of the grid clear procedure is manually controlled through spacecraft commands. However in this case, the timing of the grid clear pulse is predetermined based only on an estimate of the short resistance. If the timing is too long the thruster hardware will be damaged, and if the timing is too short, the grid clear will not be effective. However, the only short ever experienced on this mission was cleared through natural thermal cycling, and not by use of the grid clear circuitry. Consequently, the grid clear has never been attempted.

In view of the foregoing, there is a need in the art for methods and devices to safely and efficiently clear shorts in ion propulsion grids. There is also a need for such methods and devices to deliver a consistent amount of energy, independent of the short resistance. Particularly, there is a need for such methods and systems to clear low resistance shorts. The present invention satisfies all these needs.

SUMMARY OF THE INVENTION

Embodiments of the present invention employ a power supply to provide a monitored amount of electrical energy to the grids of an ion thruster to clear any potential shorts. The power supply is designed as a current source. In addition, a timer is used to limit the total energy into the thruster grids to prevent damage of the thruster and associated hardware. The timer monitors the output current and/or voltage of the power supply and automatically turns it off to prevent damage.

Thus, embodiments of the invention will enable much larger energies to be delivered to a thruster grid short without damaging the grids. Furthermore, because the grid clear circuitry automatically limits the total energy, the risk of hardware damage from improper spacecraft commands is eliminated. Also, the power supply design can be optimized to clear low resistance grid shorts, which have proven difficult to clear with the prior methods.

Embodiments of the invention can be used in any application of ion propulsion where particulate accumulation requires a grid clear to optimize operation of the propulsion system. Any ion thruster can use this invention to clear grid shorts that normally occur as a result of ion thruster operation.

A typical method embodiment of the present invention includes applying a power supply to the grid to clear contaminants, monitoring the energy applied to the grid by this power supply and suspending application of the power supply to the grid after the monitored energy substantially reaches a predetermined value. A typical device includes a controller for applying a power supply to a grid to clear the grid of contaminants and a timer for monitoring the energy applied to the grid by the applied power supply and suspending application of the power supply to the grid after the monitored energy substantially reaches a predetermined value.

BRIEF DESCRIPTION OF THE DRAWINGS

Referring now to the drawings in which like reference numbers represent corresponding parts throughout.

DETAILED DESCRIPTION INCLUDING PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

1.0 Overview

In general, embodiments of the invention involve a controlled application of a power supply to the contaminated grids of an ion thruster to bum off the residue. The power supply is designed as a constant current source. The product of the current applied from the power supply and the applied duration are limited to a preset value. Thus, the total energy delivered to clear the short is regulated. In addition, the output voltage of the power supply is limited to a predetermined value to prevent damage to the thruster and the associated hardware.

Embodiments of the invention enable much larger energies to be delivered to a thruster grid short without damaging the grids. Since the grid clear circuitry automatically limits the total energy, manual control through spacecraft commands is unnecessary. Embodiments of the invention are self-regulating in delivering a clearing electrical current to a contaminated grid. Also, the power supply design can be optimized to clear low resistance grid shorts, which have shown to be difficult to clear with the prior methods.

2.0 Exemplary Method for Clearing an Ion Propulsion Grid

Figure 1:
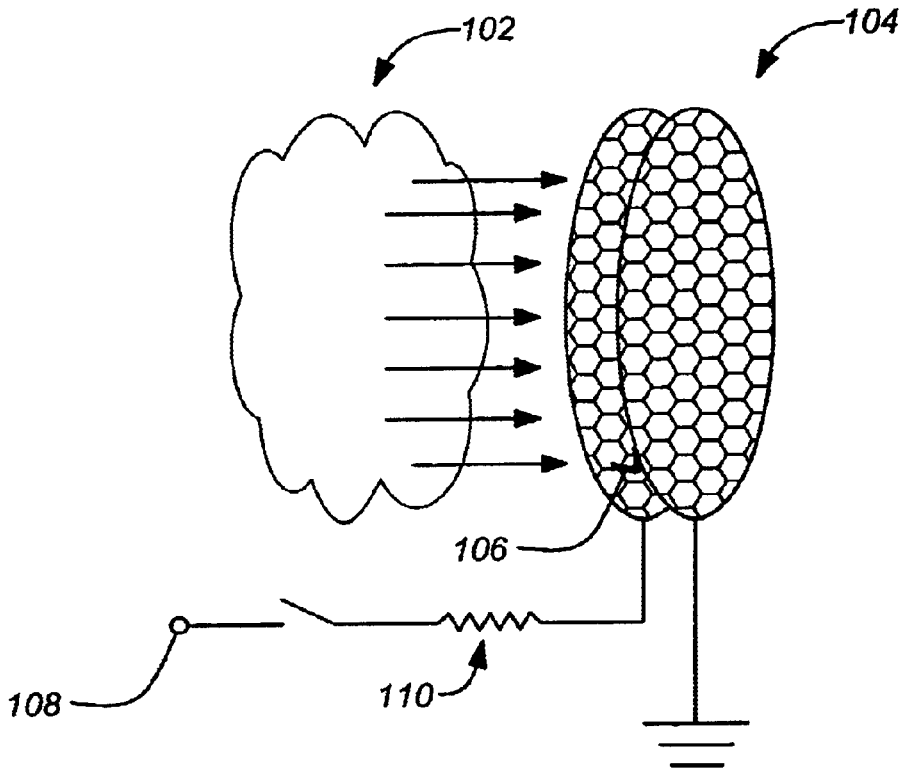
FIG. 1 PRIOR ART
FIG. 1 is a schematic diagram of a contaminated ion propulsion grid within an ion thruster.
Figure 2:
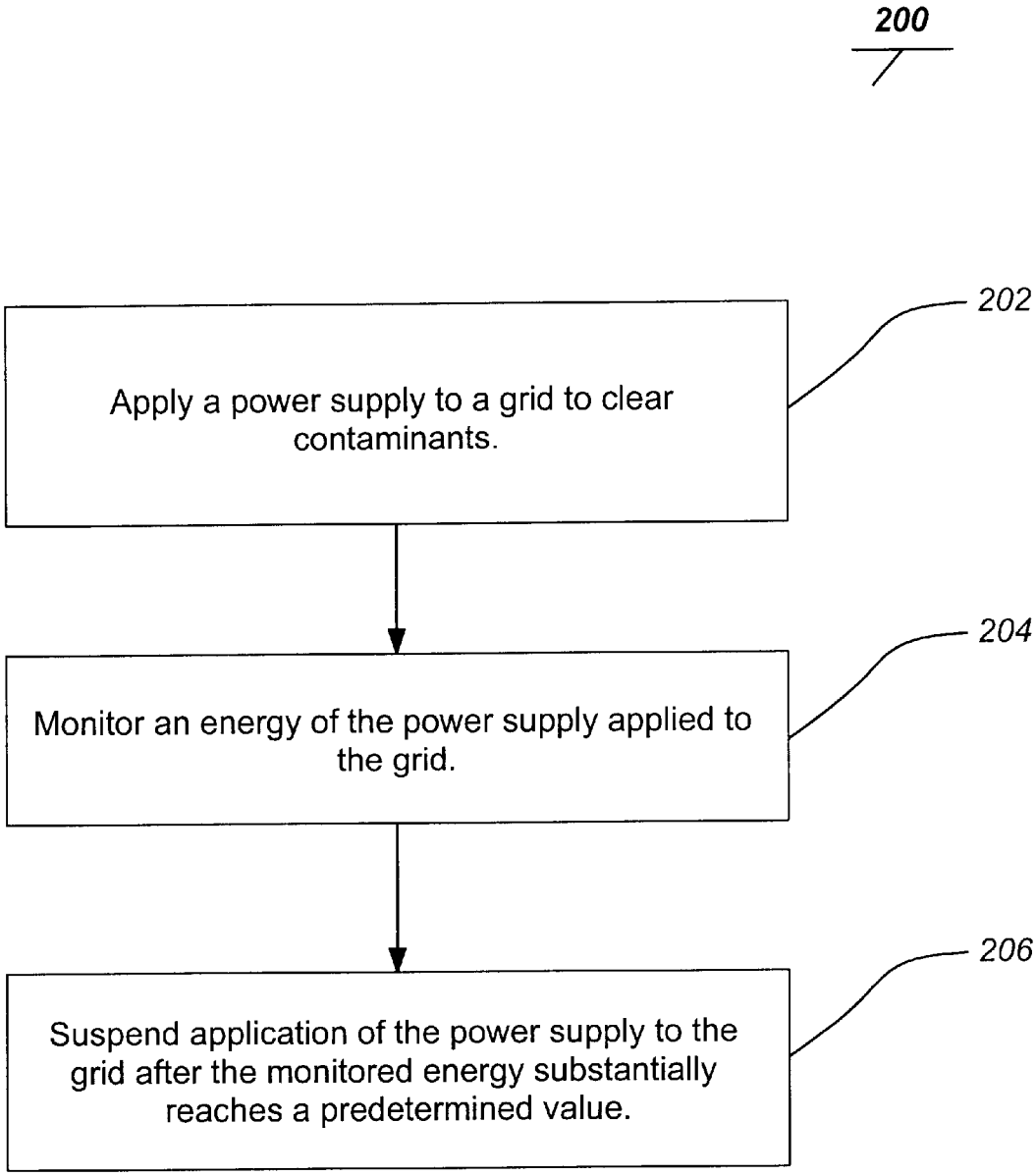
FIG. 2 is a flowchart of an exemplary method of the invention.

FIG. 2 is a flowchart of an exemplary method 200 for clearing an ion propulsion grid. At block 202, a power supply is applied to a grid to clear contaminants. The energy of the power supply applied to the grid is monitored at block 204. Finally, at block 206 application of the power supply to the grid is suspended after the monitored energy substantially reaches a predetermined value.

It is important to note that monitoring the energy supplied by the power supply does not require an explicit determination of the energy output by the power supply. It is sufficient to monitor a factor which correlates to the actual energy output. For example, the product of the power supply output current and the applied duration ($I_{out}$*Time) can be monitored as an acceptable proxy for the supplied energy. Further embodiments of the present invention can also monitor the output voltage and include it in a calculation of total energy such that the product of the current, voltage and applied duration is determined ($I_{out}$*$V_{out}$*Time). In practice, however, this turns out to be an unnecessary complication.

3.0 Exemplary Grid Clear Circuit

Figure 3A:
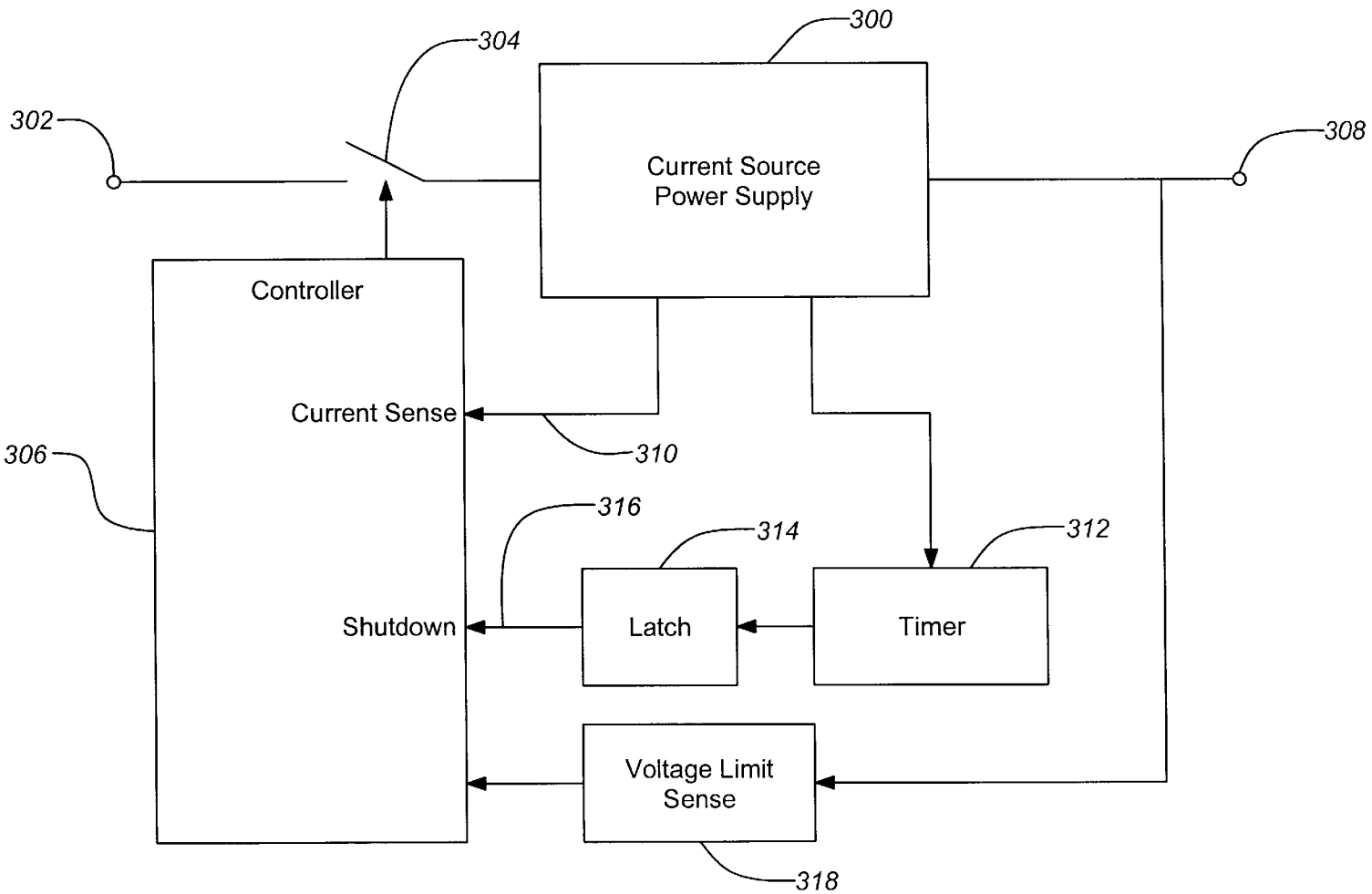
FIG. 3A depicts a functional block diagram for implementing an embodiment of the invention.

FIG. 3A depicts a functional block diagram for implementing an embodiment of the invention. A voltage (such as spacecraft bus voltage) is supplied to a dedicated power supply 300 at input 302. The voltage is pulsed through a switch 304 by the controller 306, such as a pulse width modulation controller. Through the controlled pulsed engagement of the switch 304 the controller 306 regulates the current supplied to the contaminated grids from the power supply 300 at output 308. Regulating the output 308 from the power supply 300 by the controller 306 is performed by monitoring the current supplied at the output 308 through the current sense input 310 of the controller 306 from a current feedback circuit of the power supply 300. A separate voltage limiter 318 can also be used to sense the voltage level at the output 308 of the power supply 300. The voltage limiter 318 directs the controller 306 to limit the effective voltage output to a safe level.

In addition, a timer circuit 312 is used, driven by a signal from the power supply 300, to regulate the duration of the current delivered to the contaminated grid at the output 308. The timer circuit 312 can be coupled to a latch 314 which is used to ensure that the current supply does not turn on again until the power supply 300 is turned off and the timer circuit 312 is reset. The latch 314 relays and secures the shutdown signal 316 to the controller 306 when the timer has expired.

Figure 3B:
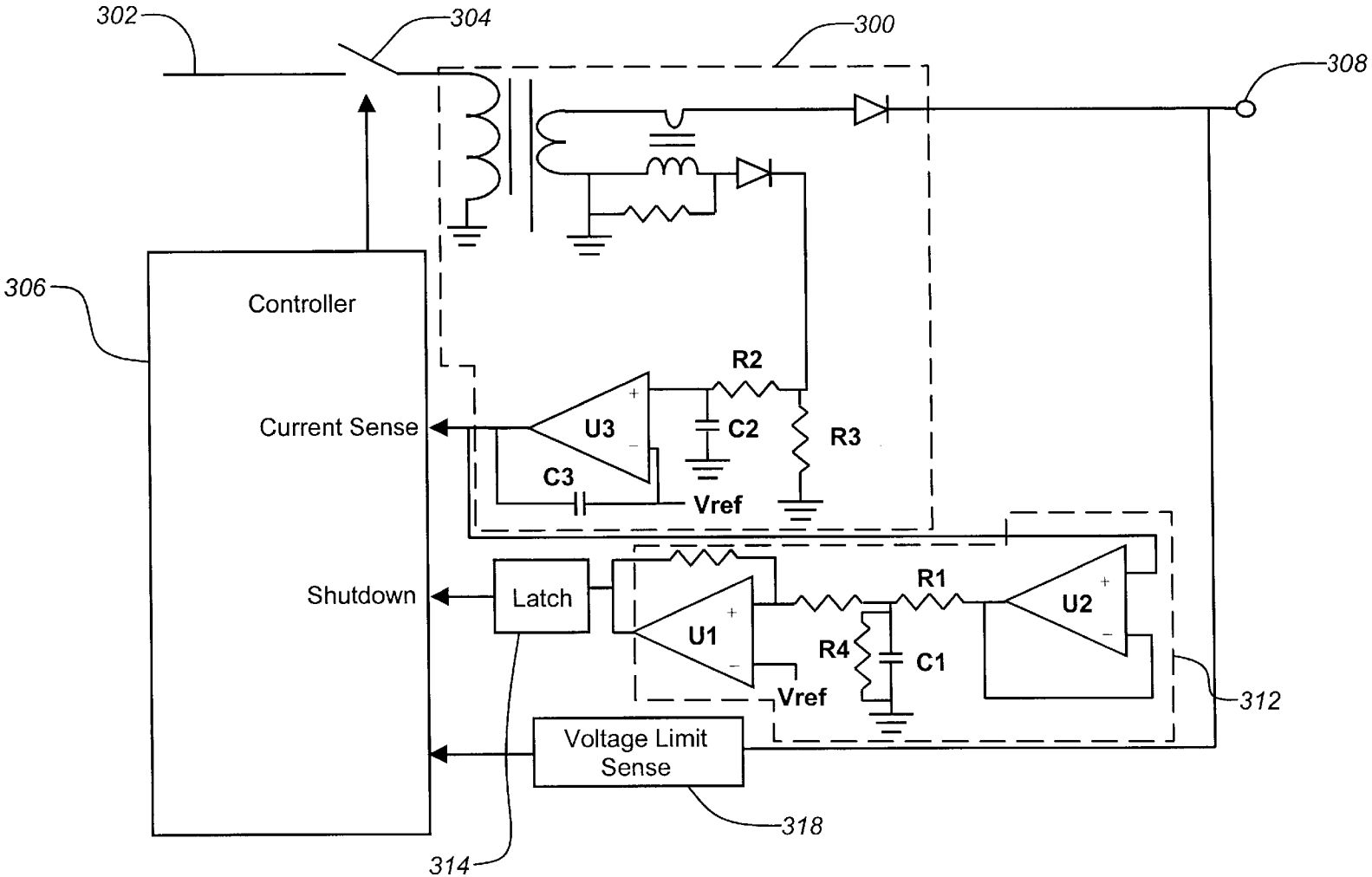
FIG. 3B depicts an exemplary schematic circuit diagram for implementing an embodiment of the invention.

FIG. 3B depicts an exemplary detailed schematic circuit diagram for implementing an embodiment of the invention. The exemplary embodiment of the invention includes a dedicated grid clear power supply 300 circuit designed as a constant current source. For example, the constant current source power supply 300 can be rated as a 10 amp supply. The controller 306 appropriately modulates activation of the switch 304 to effectively produce an alternating current (within the power supply 300) which is then passed through a transformer and rectified to produce the resulting current output 308. The output voltage can be limited through the voltage limiter 318 to some reasonable value, e.g. 20 volts.

The current feedback circuit of the power supply 300 is coupled to an additional buffer and timer circuit 312 that monitors the product of the output current and applied time ($I_{out}$*Time) and limits this to a preset value, e.g. 50 amp-seconds. Consequently, this effectively monitors the total energy that the power supply delivers to clear a grid short, regardless of the short's resistance. For example, components U1, R1, C1, U2, R4 and the latch circuit 314 operate as a monitor and timer and turn off the power supply 300 when the energy condition has been met. The U2 component comprises a unity gain buffer attached to the normal current sense voltage signal of the power supply 300. The output voltage of U2 is directly proportional to the output current. This voltage charges up C1 through R1 until U1 trips and turns off the power supply 300. The latch 314 is used to prevent the power supply 300 from turning back on, ensuring it stays off until the circuit is reset. Although the energy delivered to the grid short is theoretically $E=I_{out}*I_{out}*R_{short}*Time$, the circuit utilizes the correlating factor, $I_{out}$*Time to monitor the actual energy delivered.

Performance of the exemplary embodiment is such that if the resistance of the grid short is no greater than the maximum output voltage divided by the maximum output current ($V_{out\ max}/I_{out\ max}$), a threshold resistance value, then the power supply will always be shutdown after the same duration. This is because the current output will always be driven to its maximum limit. On the other hand, if the resistance of the grid short is larger than the threshold resistance the output voltage will be at its maximum, but the current will not reach its maximum. In this case, the applied duration will be longer and the power supply 300 will continue to run until the $I_{out}$*Time (i.e, the delivered energy) condition is met.

In addition, as previously discussed, embodiments of the present invention can also monitor the output voltage and apply it in the calculation for monitoring the total energy directed to the short. In this case, the timer circuit effectively determines the product, $I_{out}*V_{out}$*Time. In practice, however, the additional complexity makes this approach less desirable.

Figure 4A:
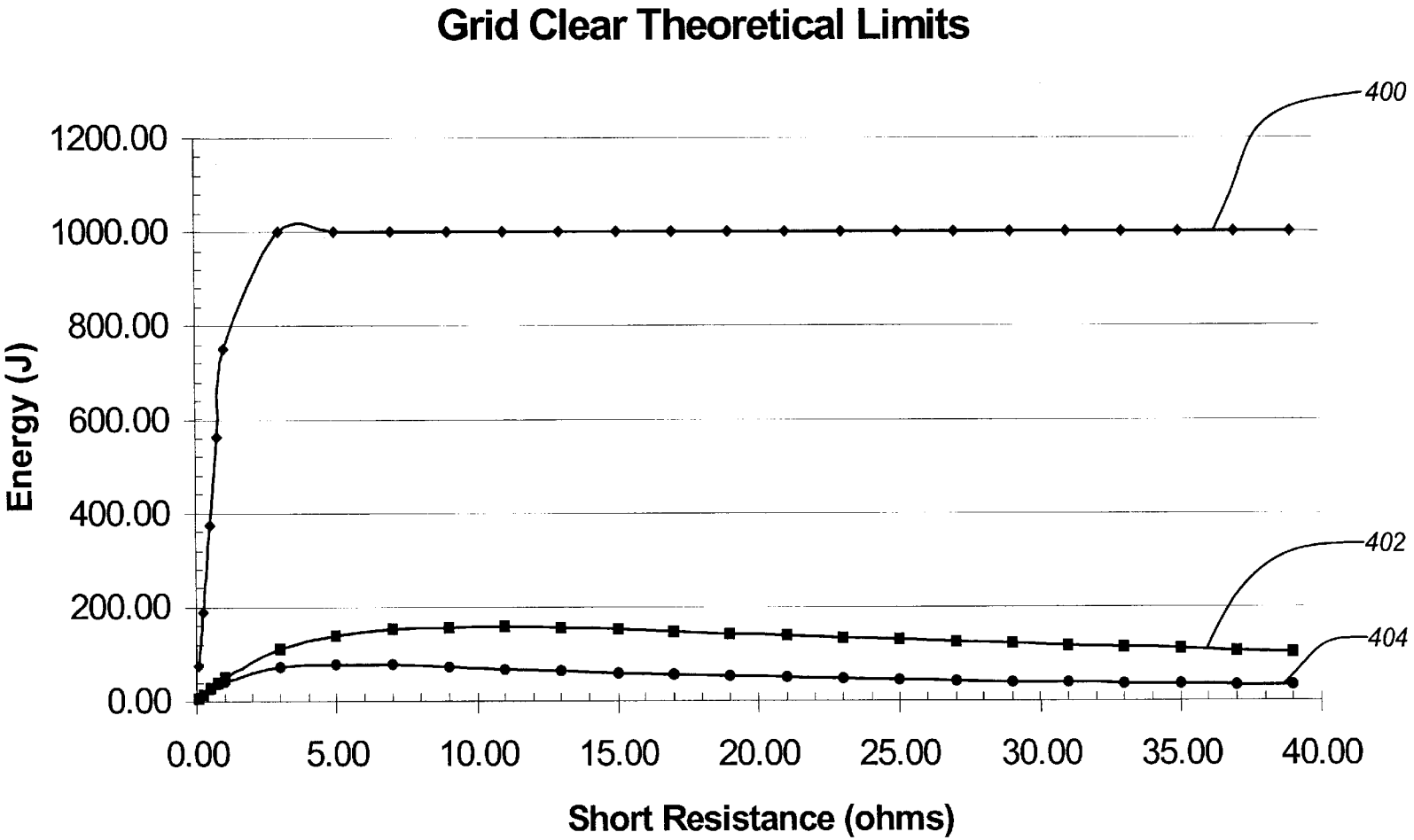
FIGS. 4A–4C are exemplary plots of theoretical energy delivery using the invention compared with prior art designs.
Figure 4B:
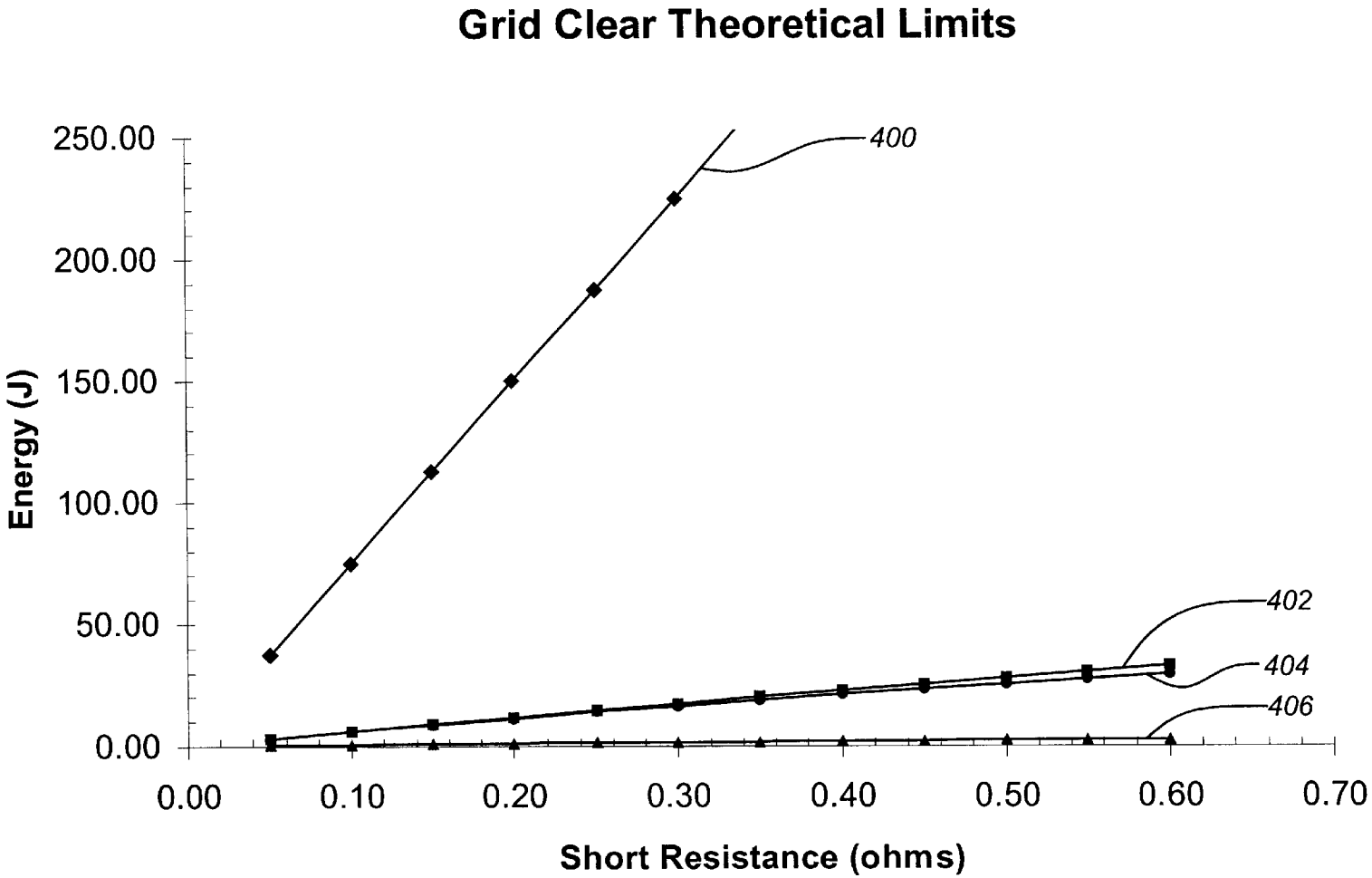

FIGS. 4A and 4B are exemplary plots of theoretical energy delivery using the invention. FIG. 4A shows the energy for a grid clear circuit embodiment of the present invention compared to two examples using the prior art "constant voltage" grid clearing technique in terms of the energy delivered to a grid short. The highest energy plot 400 is an example output of an embodiment of the invention applying a 50 Amp-second energy monitoring factor. The performance is substantially improved, reaching 1000 Joules for grid short resistances as small as 3 ohms. The other two plots 402, 404 represent examples of the prior art approach. Both the prior examples used a fixed resistor switch to the spacecraft bus voltage. In the case of plot 402, a 10 ohm dropping resistor was switched to a 100V bus for 640 milliseconds. In the case of plot 404, a 5 ohm dropping resistor was switched to a 50V bus for 640 milliseconds. FIG. 4B uses a reduced resistance scale to focus on low resistance shorts (e.g., 0.6 ohms and lower). Here an additional plot 406 is shown, representing a 5 ohm dropping resistor was switched to a 50V bus for only 60 milliseconds, highlighting the sensitivity of the prior art approach to the duration of the applied voltage.

Figure 4C:
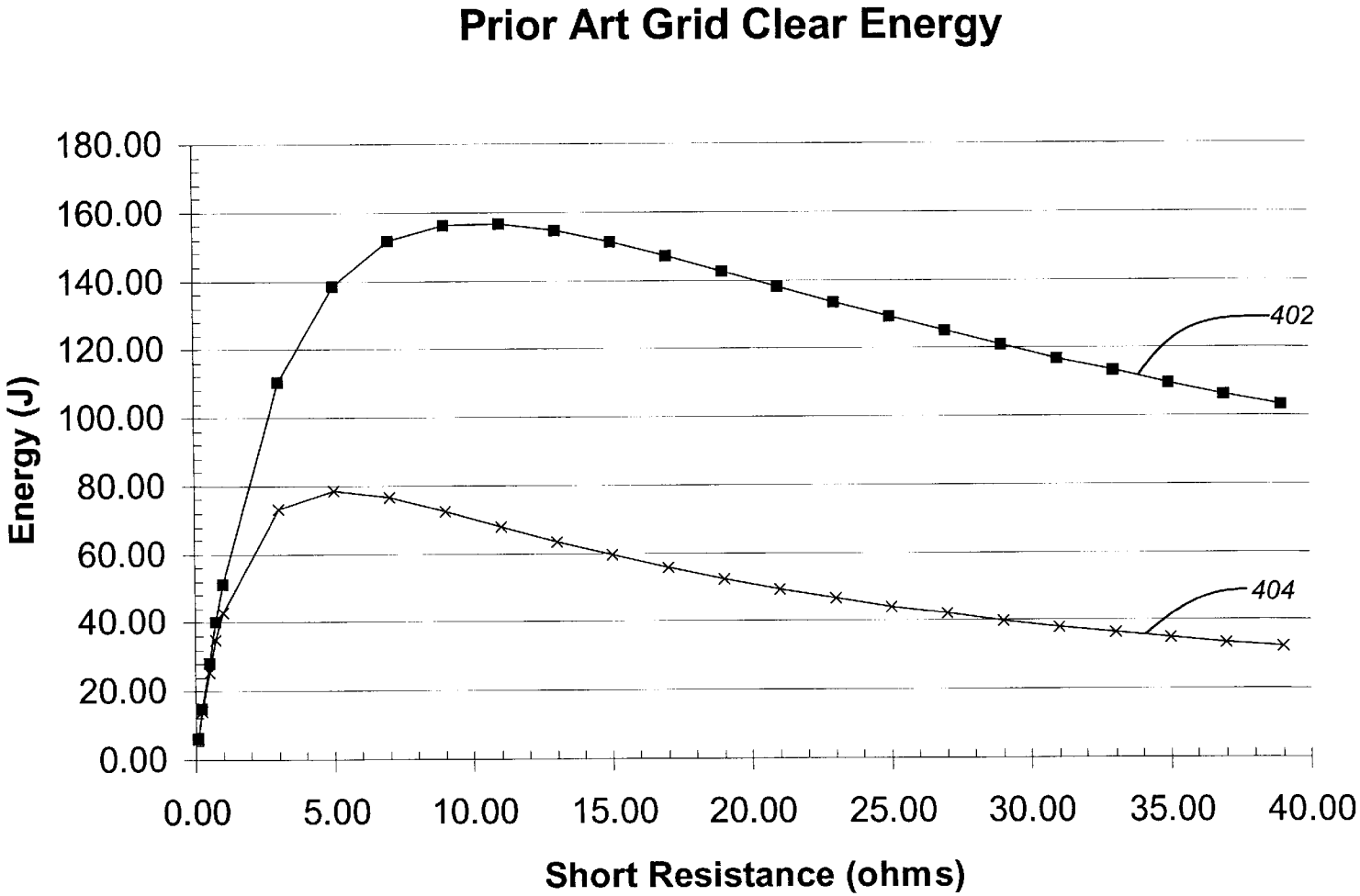

In addition, FIG. 4C uses a reduced energy scale of the energy plots 402, 404 of FIG. 4A to provide a clearer illustration of the characteristic energy peaks indicative of the prior art. Theoretically, the energy peaks occur when the short resistance is equivalent to the value of the dropping resistor (10 ohms in this example) and an equal amount of energy is being applied to both the short and the dropping resistor. However, when the short resistance is lower than the value of the dropping resistor, more energy is being dissipated in the dropping resistor than the grid short. In contrast, embodiments of the present invention, using a grid clear power supply instead of the dropping resistor, are inherently more efficient; the efficiency of this grid clear power supply can be between approximately 65% and 85%. Thus, embodiments of the invention deliver significantly more energy to the grid short than is consumed by the grid clear power supply across a wide range of potential short resistance values.

CONCLUSION

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the invention. Since many embodiments of the invention can be made without departing from the scope of the invention, the invention resides in the claims hereinafter appended.

What is claimed is:

1. A method of clearing an ion thruster grid, comprising:

applying a power supply to a grid to clear contaminants;

monitoring an energy applied to the grid of the applied power supply; and suspending application of the power supply to the grid after the monitored energy substantially reaches a predetermined value.

2. The method of claim 1, further comprising limiting a voltage of the power supply applied to the grid to a maximum output voltage, $V_{out\ max}$.

3. The method of claim 1, wherein the applied power supply comprises a current source power supply.

4. The method of claim 1, wherein the applied power supply is regulated by a pulse width modulation controller.

5. The method of claim 1, wherein suspending application of the power supply to the grid is performed by a latch.

6. The method of claim 1, wherein applying the power supply comprises applying a current to the grid.

7. The method of claim 6, wherein the current applied to the grid is substantially constant.

8. The method of claim 6, wherein applying the current includes applying a maximum output current, $I_{out\ max}$, of the power supply if a grid short resistance is no greater than a maximum output voltage, $V_{out\ max}$, divided by the maximum output current.

9. The method of claim 6, wherein applying the current includes applying a maximum output voltage, $V_{out\ max}$, of the power supply if a grid short resistance is greater than the maximum output voltage divided by a maximum output current, $I_{out\ max}$.

10. The method of claim 6, wherein monitoring the energy applied includes monitoring the current from the power supply multiplied with a duration of the applied power supply.

11. The method of claim 10, wherein monitoring the current from the power supply multiplied with the duration of the applied power supply is performed by charging a capacitor through a resistor.

12. The method of claim 10, wherein monitoring the energy applied further includes monitoring the current multiplied with the duration and a voltage output of the applied power supply.

13. A device for clearing an ion thruster grid, comprising:

a controller for applying a power supply to a grid to clear the grid of contaminants; and a timer for monitoring an energy applied to the grid of the applied power supply and suspending application of the power supply to the grid after the monitored energy substantially reaches a predetermined value.

14. The device of claim 13, further comprising a voltage limiter for limiting a voltage of the power supply applied to the grid to a maximum output voltage, $V_{out\ max}$.

15. The device of claim 13, wherein the applied power supply comprises a current source power supply.

16. The device of claim 13, wherein the controller comprises a pulse width modulation controller.

17. The device of claim 13, further comprising a latch coupled to the timer for suspending application of the power supply to the grid.

18. The device of claim 13, wherein the controller regulates applying a current from the power supply to the grid.

19. The device of claim 18, wherein the current applied to the grid is substantially constant.

20. The device of claim 18, wherein the controller regulates the current to apply a maximum output current, $I_{out\ max}$, of the power supply if a grid short resistance is no greater than a maximum output voltage, $V_{out\ max}$, divided by the maximum output current.

21. The device of claim 18, wherein the controller regulates the current to apply a maximum output voltage, $V_{out\ max}$, of the power supply if a grid short resistance is greater than the maximum output voltage divided by a maximum output current, $I_{out\ max}$.

22. The device of claim 18, wherein the timer monitors the current from the power supply multiplied with a duration of the applied power supply.

23. The device of claim 22, wherein the timer monitors the current from the power supply multiplied with the duration of the applied power supply by charging a capacitor through a resistor.

24. The device of claim 22, wherein the timer monitors the energy applied by monitoring the current multiplied with the duration and a voltage output of the applied power supply.

* * * * *